US006623292B1

(12) United States Patent
Holler et al.

(10) Patent No.: US 6,623,292 B1
(45) Date of Patent: Sep. 23, 2003

(54) CARD EDGE CONNECTOR ADAPTED TO PROVIDE VISUAL STATUS INDICATION

(75) Inventors: Ronald P. Holler, Mechanicsburg, PA (US); Deborah A. Ingram, Etters, PA (US); William A. Northey, Etters, PA (US); Alan David Crighton, Apex, NC (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/698,772

(22) Filed: Oct. 27, 2000

(51) Int. Cl.[7] ..... H01R 3/00
(52) U.S. Cl. ..... 439/490; 439/910
(58) Field of Search ..... 439/490, 157–160, 439/910

(56) References Cited

U.S. PATENT DOCUMENTS

| | | | | |
|---|---|---|---|---|
| 4,377,315 A | | 3/1983 | Grau | |
| 4,869,681 A | | 9/1989 | Vache et al. | 439/341 |
| 5,132,880 A | * | 7/1992 | Kawamura | 362/32 |
| 5,359,492 A | * | 10/1994 | Porter | 361/683 |
| 5,644,470 A | | 7/1997 | Benedict et al. | 361/686 |
| 5,704,802 A | * | 1/1998 | Loudermilk | 439/490 |
| 5,790,041 A | | 8/1998 | Lee | 340/815 |
| 5,801,926 A | | 9/1998 | Cutsforth et al. | 361/754 |
| 5,822,196 A | | 10/1998 | Hastings et al. | 361/801 |
| 5,865,649 A | | 2/1999 | Yu et al. | 439/637 |
| 6,095,851 A | * | 8/2000 | Laity et al. | 439/490 |

OTHER PUBLICATIONS

AMP Drawing No. 1364456 dated Aug. 2000.

* cited by examiner

*Primary Examiner*—Khiem Nguyen
(74) *Attorney, Agent, or Firm*—M. Richard Page

(57) ABSTRACT

An edge connector for receiving a first circuit board, circuit card, etc. comprises a housing having a circuit board receiving groove. A plurality of electrical contacts are arranged in the board receiving groove. An ejector member is provided for ejecting the board from the housing, the ejector member is translucent or transparent. A light emitter is optically coupled to the ejector member, so that when the light emitter is lit, the light from the light emitter is transmitted through the translucent or transparent ejector member to provide a visual indication which can be seen by the person inserting the circuit board into the connector.

15 Claims, 8 Drawing Sheets

CARD EDGE CONNECTOR ADAPTED TO PROVIDE VISUAL STATUS INDICATION

BACKGROUND OF THE INVENTION

1. Field of the Invention

The present invention relates to electrical connectors and more particularly to card edge connectors adapted to provide visual status indication.

2. Brief Description of the Prior Developments

Various card edge connectors are known in the art. Typically the front edge of a circuit board is inserted in a longitudinal groove of an insulated housing. Adjacent that groove there are a plurality of contacts with arcuate conductive sections arranged in side by side relation adjacent the groove so that conductive pads on the printed wiring board contact the arcuate sections of the contacts as the board is inserted into the groove. Typically such connectors employ a latching member to lock the printed wiring board in place and an ejector for aiding in removing the card from the connector. In some cases the latch and ejector are formed from a single member. U.S. Pat. No. 5,865,649 to Yu et al., is illustrative of such a connector and is incorporated by reference herein. U.S. patent application Ser. No. 08/621,214 to C. Peterson et al., filed Mar. 22, 1996 for a Locking Ejecting Device For Edge Card Connector and U.S. patent application Ser. No. 08/588,661 to Yip et al. filed Jan. 19, 1996, for a Printed Circuit Board Connector With Locking Ejector, further illustrate such a connector and are incorporated by reference herein.

There is a need to have a visual indication that a device, such as a circuit board or memory card, is properly inserted in the connector and/or that the device is operating properly. There have been numerous efforts to develop such visual indications as illustrated in the following patents: U.S. Pat. Nos. 4,377,315, 4,869,681, 5,359,492, 5,644,470, 5,801,926 and 5,822,196. Most of these approaches add complexity and cost to the connector.

In U.S. Pat. No. 5,790,041 a jack is provided with an opening that allows light from a light emitter to enter the jacks cavity and emerge from the front opening, as by the insertion of a transparent plug.

SUMMARY OF THE INVENTION

In a preferred embodiment of the present invention, an edge connector is provided for receiving a first circuit board. The connector is adapted to provide visual status indication. The connector includes a housing having a circuit board receiving groove and a plurality of electrical contacts arranged in the circuit board receiving groove. An ejector member is provided for ejecting the board from the housing. The ejector member is preferably formed from a translucent or transparent material. A light emitter is optically coupled to the ejector member, so that when the light emitter is lit, the light from the light emitter is transmitted through the translucent or transparent ejector member to provide a visual status indication, which can be seen by the person inserting the circuit board into the connector.

In one preferred embodiment the housing is mounted on a second circuit board and the light emitter comprises an LED mounted on the second circuit board adjacent the ejector member. In another preferred embodiment the LED is surface mounted on the second circuit board adjacent the ejector member. In yet another preferred embodiment the LED is mounted in a hole in the second circuit board adjacent the ejector member. In a still further preferred embodiment the LED comprises part of the connector and is mounted on the housing adjacent to the ejector member. In yet another preferred embodiment the LED is mounted on the second circuit board next to the housing so that the ejector member is coupled to the LED when the first circuit board is loaded in the housing. In a further preferred embodiment the LED comprises part of the connector and is mounted on the housing so that the ejector member is coupled to the LED when the first circuit board is inserted in the connector.

Most preferably the ejector member is a unitary member which may also comprise a latching member, which locks the first circuit board in place when it is inserted into the connector.

It is an aim of the present invention to provide an edge connector which provides visual status indication in a simple and cost effective manner.

BRIEF DESCRIPTION OF THE DRAWINGS

In the accompanying drawings corresponding reference numbers refer to similar components. The foregoing aspects and other features of the invention are explained in the following description, taken in connection with the accompanying drawings, wherein.

DETAILED DESCRIPTION OF THE PREFERRED EMBODIMENTS

While the present invention will be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

By way of example the invention will be described by reference to an edge connector of the type described in U.S. Pat. No. 5,865,649 to Yu et al., which is incorporated by reference herein. However, the invention is applicable to a wide range of edge connectors and it is not limited to the particular design shown in the Yu et al. patent.

Figure 1:
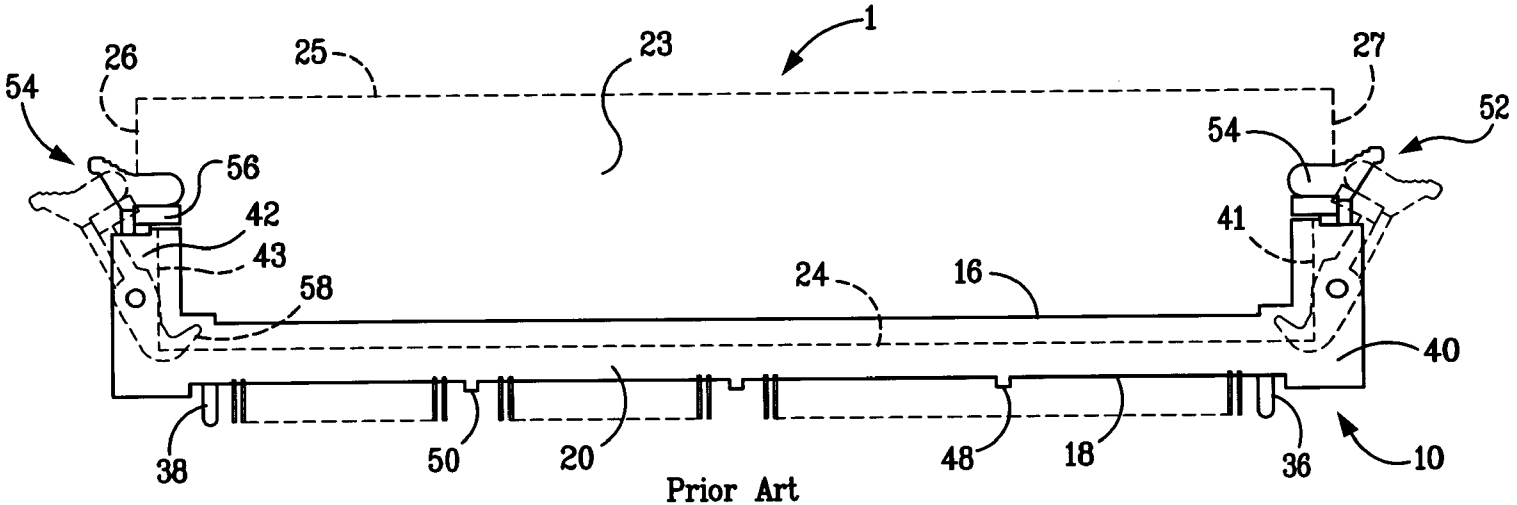
Prior Art FIG. 1
FIG. 1 is a side elevational view of a conventional card edge connector to which the present invention can be applied.
Figure 2:
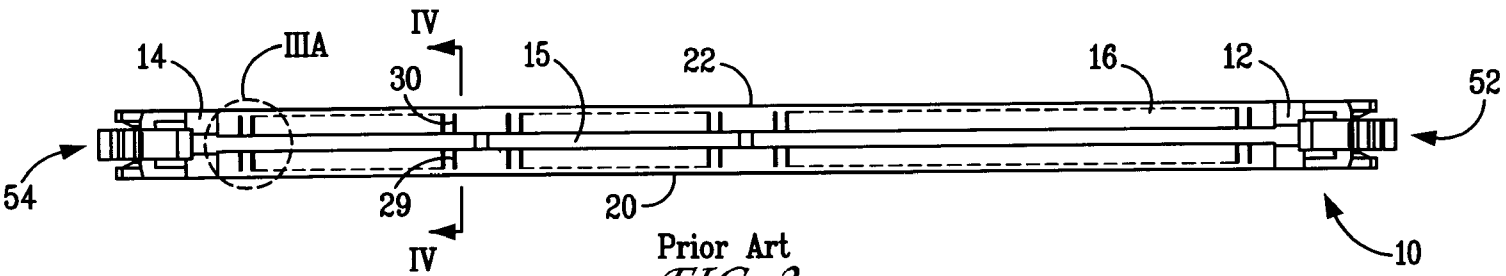
Prior Art FIG. 2
FIG. 2 is a top plan view of the card edge connector shown in FIG. 1.
Figure 3:
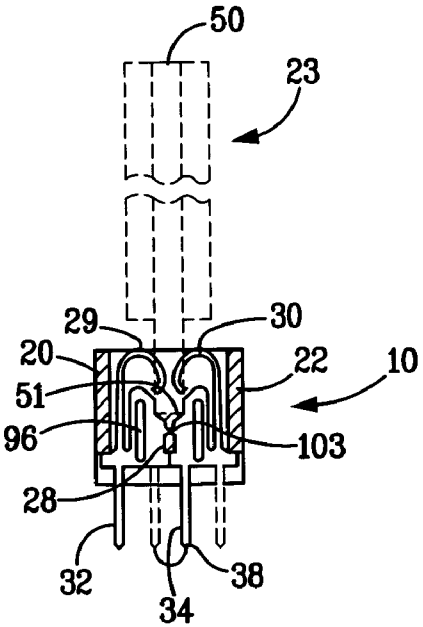
FIG. 3 Prior Art
FIG. 3 is a cross sectional view through line IV—IV in FIG. 2.

Referring to the FIGS. 1–5, an edge connector 1 includes a molded insulative housing 10 which has a first end 12 and a second end 14 which are connected by a groove 15 in its topside 16. This housing also includes a bottom side 18 and a first lateral side 20 and a second lateral side 22. A printed wiring board is shown in phantom lines generally at numeral 23. This board has a front edge 24 which engages the groove 15 in the housing 10 and an opposed top edge 25 and a first side edge 26 and a second side edge 27. The front edge is supported on board rest 28 (FIG. 3). The printed wiring board 23 has conductive pads (not shown) disposed along each side of edge 24. Rows of contacts or terminals as at 29 and 30 (FIG. 2) are positioned on opposite sides of the groove 15. Each contact or terminal 29 or 30 forms an electrical connection with a corresponding one of the conducting pads.

Extending from the bottom side of the housing are leads as at 32 and 34 and non-conductive locating pins as at 36 and 38 both of which engage a mother board (not shown). The housing also includes a first upstanding member 40 which has a groove 41 aligned with and substantially the same width as groove 15 and a second upstanding member 42 which also has a groove 43 aligned with and substantially the same width as groove 15. Tabs 44A,B and 46A,B extend from members 40 and 42 respectively. The grooves 41 and 43 also extend vertically through these tabs. The housing also includes stand-offs as at 48 and 50 which bear against the mother board when the housing is engaged with the mother board. Finally, the edge connector includes a first latching member shown generally at numeral 52 and a second latching member shown generally at 54.

Figure 4:
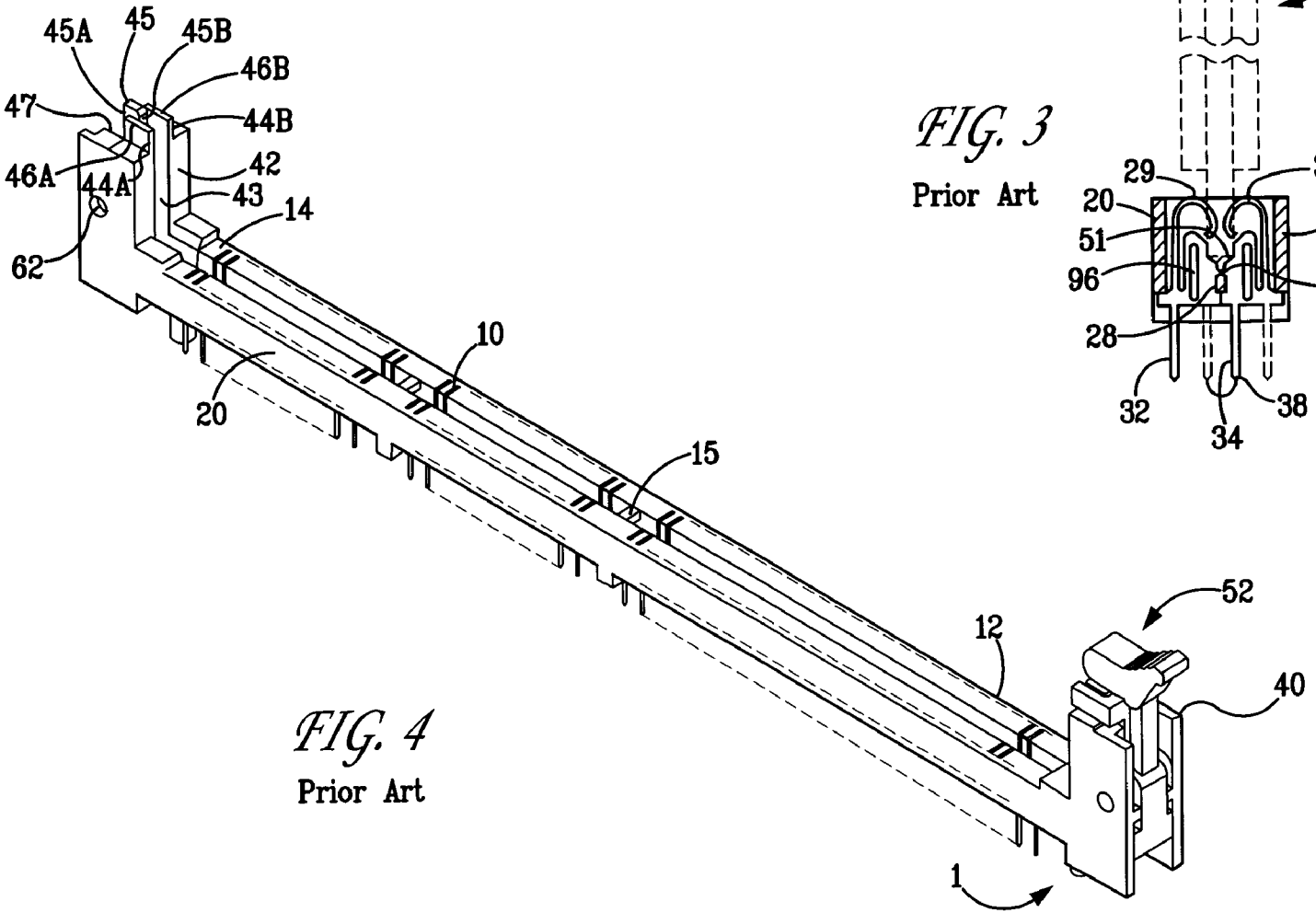
FIG. 4 Prior Art
FIG. 4 is a perspective view of the card edge connector shown in FIG. 1 in which one latching mechanism has been removed to better display other aspects of the edge connector.
Figure 5B:
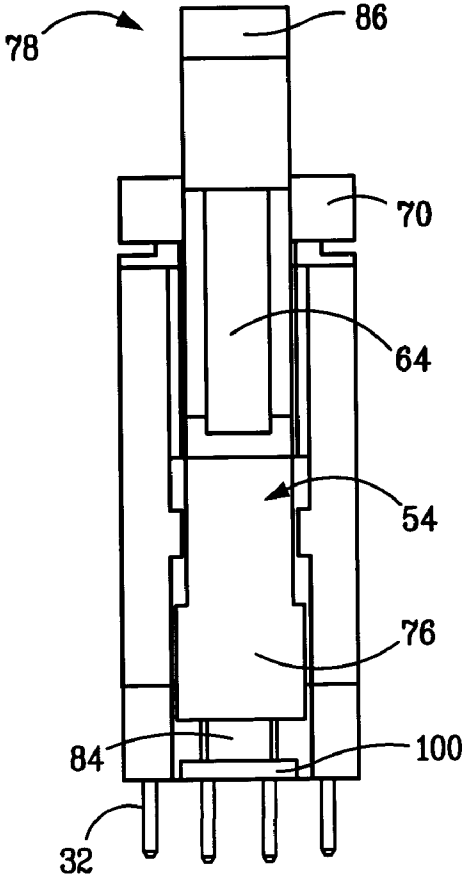
FIG. 5B is an end view of the latching mechanism shown in FIG. 5A.
Figure 5A:
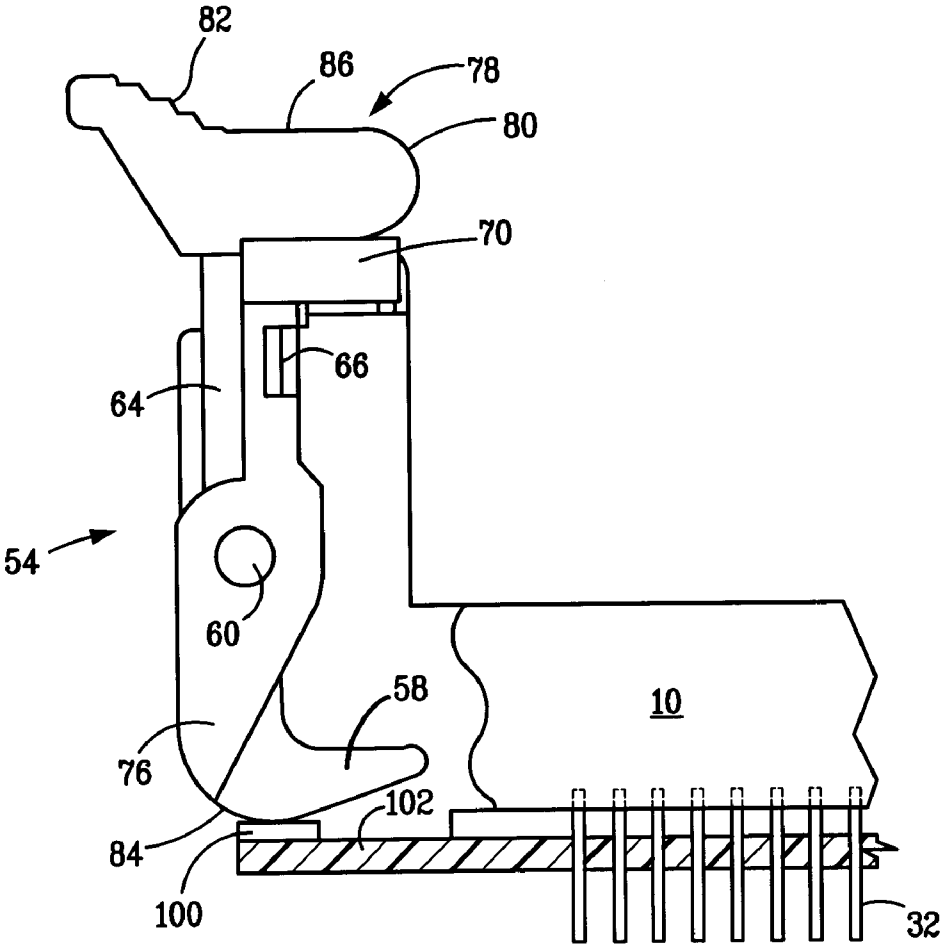
FIG. 5A is a partially cut away, partially cross-sectioned, side elevational view of a latching indicator mechanism used in one preferred embodiment of the edge connector of the present invention.

Referring to FIGS. 4 and 5A, each tab 44A,B, 46A,B has a raised rib, such as ribs 46A, 46B extending adjacent the front edge of the tab. The upstanding members 40 and 42 each include a split web 45 having portions 45A and 45B. The web is split so that the opposed portions of each of upstanding members 40 and 42 can move toward and away from each other. On the interior surfaces of the upstanding members, 40 and 42, adjacent the webs 45 are a pair of V-shaped grooves 47 that are sized to receive the projections 66 on both sides of the latching members 52 and 54.

Referring to FIGS. 1–5, each of these latching mechanisms includes an upper shank 56 and a lower ejectment or ejector hook 58. On the upper shank 56 there are lateral pivot projections 60 on both sides of the latching members 52 and 54 by means of which the latching mechanism is fixed to apertures 62 in the insulative housing 10. The latching mechanisms also include a longitudinal rib 64 as well as lateral engagement projections 66, fingers 70 and lateral tabs on both sides of the members 52 and 54. Each of the latching members 52 and 54 pivots on projections 60 from a position in which it is engaged with printed wiring boards 23 as shown in solid lines FIG. 1 to a rearward angular position in which it is disengaged from the board 23 as shown in phantom. With the latches in their rearward disengaged position, the printed wiring board 23 may be inserted in the housing 10 so that its front edge 24 engages groove 15 and its side edges 26 and 27 respectively engage grooves 41 and 43 in the vertical members 40, 42. Because the web 45 is split, the grooves 41 and 43 are slightly wider than the thickness of the board 23 and the board easily slips into the connector 1.

As the printed wiring board 23 is pushed into slot 15, the edge 24 of the board engages the ejector hook 58 of each latch member 52 and 54 causing the latch members to pivot on projections 60. As the latch members 52 and 54 pivot, fingers 70 slide over tabs 44A,B and 46A,B. The fingers 70 engage the raised ribs on the tabs 44A,B, 46A,B and cam these tabs inwardly so that the edges of grooves 41 and 43 are pressed against and clamp against the opposed lateral sides of the printed wiring board to thereby securely hold the printed wiring board in the connector. As the latch moves to the closed position, the projections 66 snap into the grooves 47, so that each latch is locked in the closed position. The latching mechanism also includes a head section shown generally at numeral 78. In the locked position, the front nose 80 of the head section will engage a recess in the printed wiring board so that the board is properly located and secured in position. The latching mechanism will ordinarily be manipulated by means of the finger tab 82, to rotate the latch and eject the board from the connector.

In accordance with the present invention the edge connector 1 is adapted to provide visual status indication in a simple and cost effective manner. Examples of visual status indication, for example, could include indications that the circuit card or board is properly inserted or that the card or board is operating properly. Other visual indications as desired could also be provided. Preferably the edge connector is a circuit card edge connector.

In a preferred embodiment of the present invention, an edge connector 1 is provided for receiving a first circuit board or card 23. The terms board or card are used herein interchangeably. Typically they are boards, cards or modules such as printed wiring boards containing one or more electronic devices. They may be rigid or flexible as desired.

The connector 1 is adapted to provide visual status indication. The connector 1 includes a housing 10 having a circuit board receiving groove 15 and a plurality of electrical contacts 29 and/or 30 arranged in the circuit board receiving groove. A latch and/or ejector member 52 and 54 is provided for ejecting the board 23 from the housing 10. Due to the close stacking of connectors 1 on a motherboard 102, it is often difficult to see a board mounted LED or to determine which LED corresponds to which connector 1. Therefore, the ejector member 52 and/or 54 is preferably formed from a translucent or transparent material. A light emitter 100 is optically coupled to the ejector member 52 and/or 54, so that when the light emitter 100 is lit, the light from the light emitter is transmitted through the translucent or transparent ejector member to provide a visual status indication. The light emitter 100 preferably is an LED (light emitting diode), however, any desired light source can be utilized.

The description which follows deals with the ejector member 52 of the connector 1. While generally only one of the latch members 52 or 54 will be coupled to a light emitter 100 for simplicity and cost effectiveness, if desired both latch members can be made of transparent or translucent material and both can be coupled to the same or different light emitters 100.

Referring to FIGS. 5A and 5B, in accordance with one preferred embodiment of the invention, the housing 10 is mounted on a second circuit board 102 and the light emitter 100, is mounted on the second circuit board 102 adjacent to the latch member 54. In this embodiment the light emitter 100 is not supported by the housing 10. The ejector end 84 of the ejector member 54 gathers light from the emitter 100 and transmits the light to the opposing free end or latching end 86 of the ejector member 54 where it can be easily seen by a person after the circuit board 23 is inserted into the connector 1. In this embodiment the ejector member 54 is an elongated member having opposing ends 84 and 86. The light emitter 100 is placed on the circuit board 102 so that when the connector 1 is also placed on the circuit board the light emitter will be closely adjacent to the end 84 of the ejector member 54 when the circuit board 23 is fully inserted and latched in the connector. In the embodiment shown the light emitter 100 is arranged immediately below the ejector end 84 of the member 54. In this preferred embodiment the light emitter 100 is preferably an LED (light emitting diode) which is surface mounted to the second circuit board 102. The ejector member 54 is shown in contact with the light emitter 100, however, optically coupling the light emitter 100 to the ejector end 84 of the ejector member 54 does not require contact between these two elements, only optical coupling.

Figure 6B:
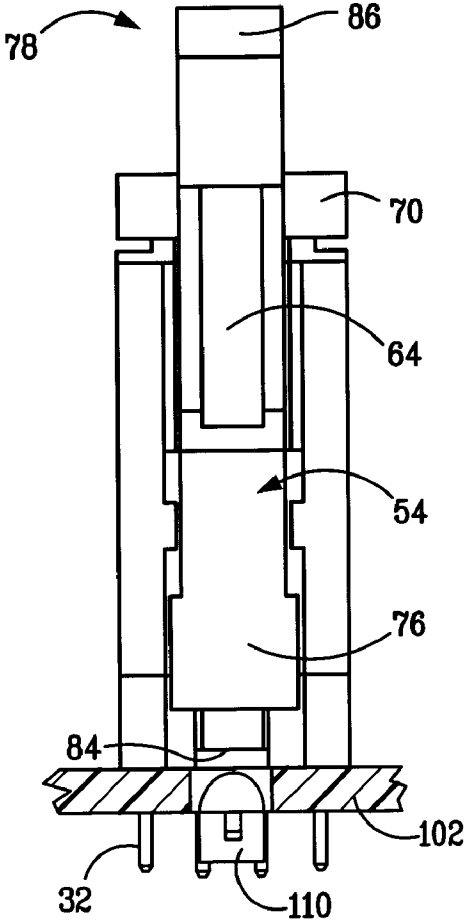
FIG. 6B is an end view of the latching mechanism shown in FIG. 6A.
Figure 6A:
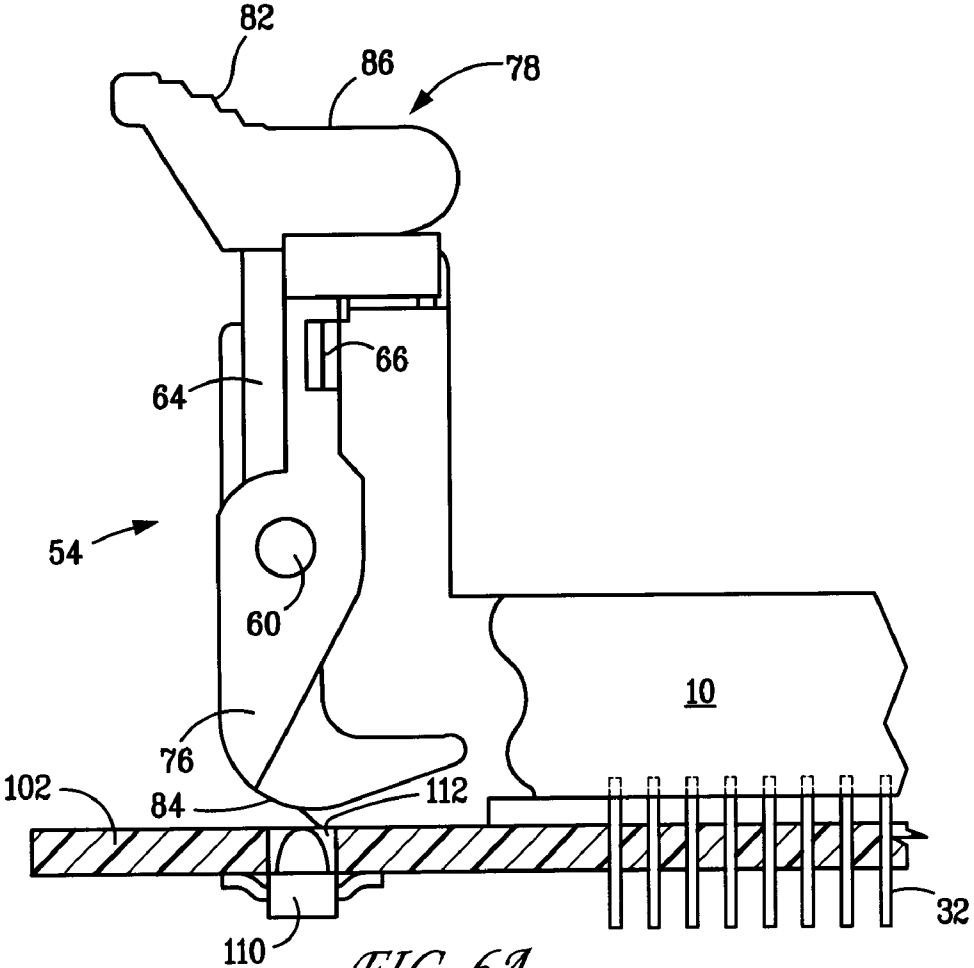
FIG. 6A is a partially cut away, partially cross-sectioned, side elevational view of the latching indicator mechanism used in another preferred embodiment of the edge connector of the present invention.

Referring now to FIGS. 6A and 6B, in another preferred embodiment the light emitter 110 is reverse surface mounted to the second printed circuit board 102 in a hole 112 in the second circuit board 102 adjacent to the ejector end 84 of the ejector member 54. In this embodiment the ejector end does not contact the light emitter 110 but rather is spaced therefrom. If desired, there could be contact as in the previous embodiment. The light emitter 110 is preferably an LED arranged closely adjacent to the ejector end 84 of the member 54. In FIG. 6 the light emitter 110 is arranged below the ejector end 84 of the ejector member 54. It is only required that the light emitter 110 be optically coupled to the ejector member 54 so that light is transmitted through the member to the opposing end of the member 86.

Figure 7A:
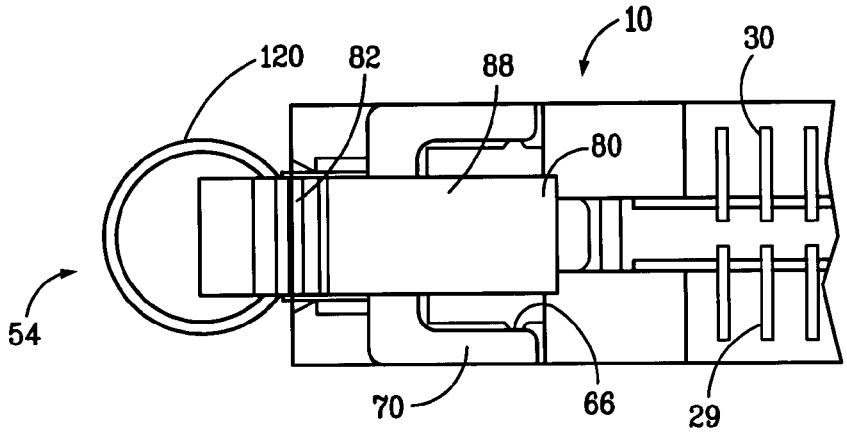
FIG. 7A is a top view of the latching mechanism shown in FIG. 7B.
Figure 7B:
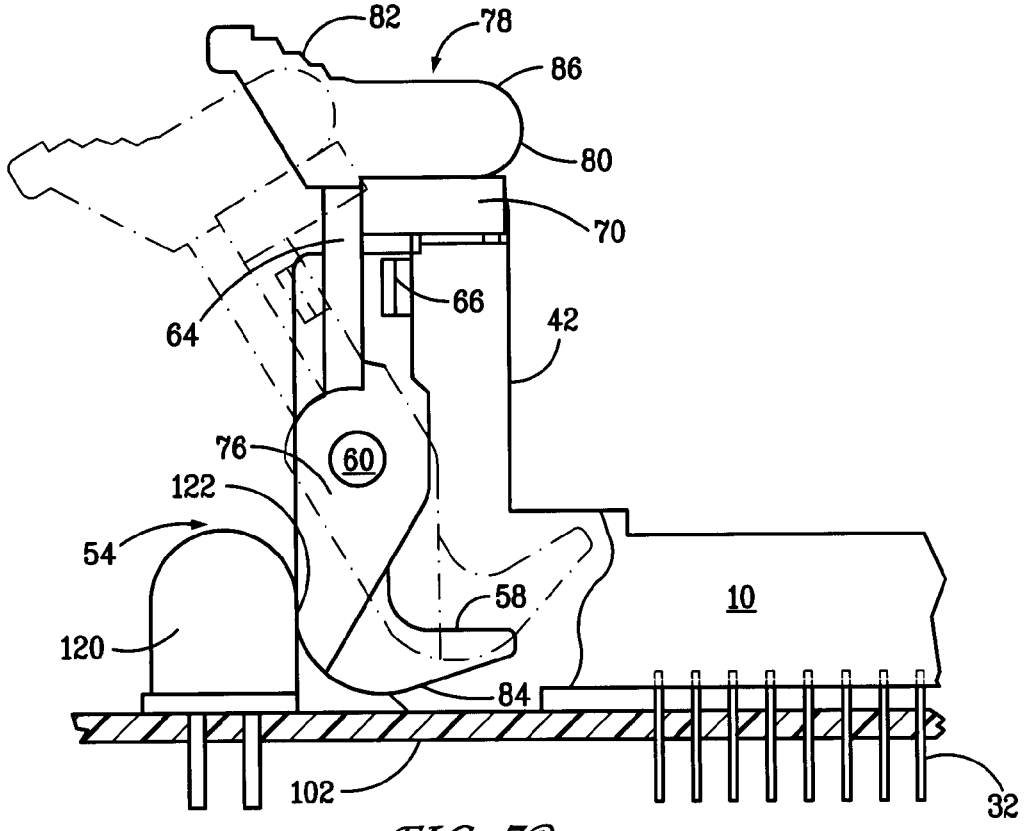
FIG. 7B is a partially cut away, partially cross-sectioned, side elevational view of the latching indicator mechanism used in yet another preferred embodiment of the edge connector of the present invention.

Referring now to FIGS. 7A and 7B a still further preferred embodiment is shown wherein the light emitter 120 is mounted on the second circuit board 102 next to the housing 10 so that the ejector member 54 is in contact with the light emitter only when the first circuit board 23 is loaded in the housing 10 and the member 54 is in its locked position. Preferably the light emitter 120 is arranged closely adjacent to the second upstanding member 42 at its external edge 121. When the ejector member 54 is in its unlatched position as shown in phantom the ejector end 84 is spaced apart from the light emitter 120 thereby reducing any optical coupling between the emitter 120 and the member 54 and avoiding false visual indications from occurring. When the ejector member 54 is latched by the insertion of the circuit board 23 the rear portion 122 of the ejector end 84 of the ejector member 54 contacts the light emitter 120 to provide intimate optical coupling and a clear visual indication transmitted to the latching end 86 of the member 54 when the emitter 120 is lit. As in the previous embodiments the emitter 120 may be an LED or any other desired light emitter.

Figure 8A:
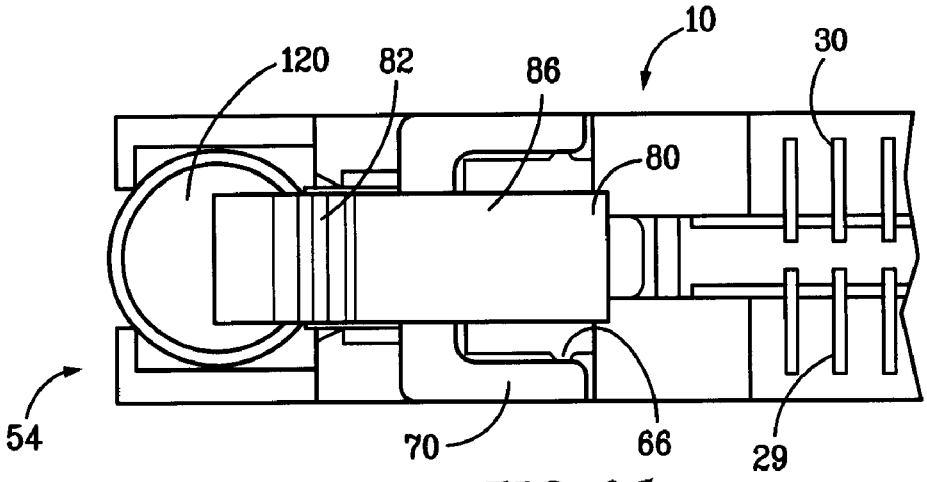
FIG. 8A is a top view of the latching mechanism shown in FIG. 8B.
Figure 8B:
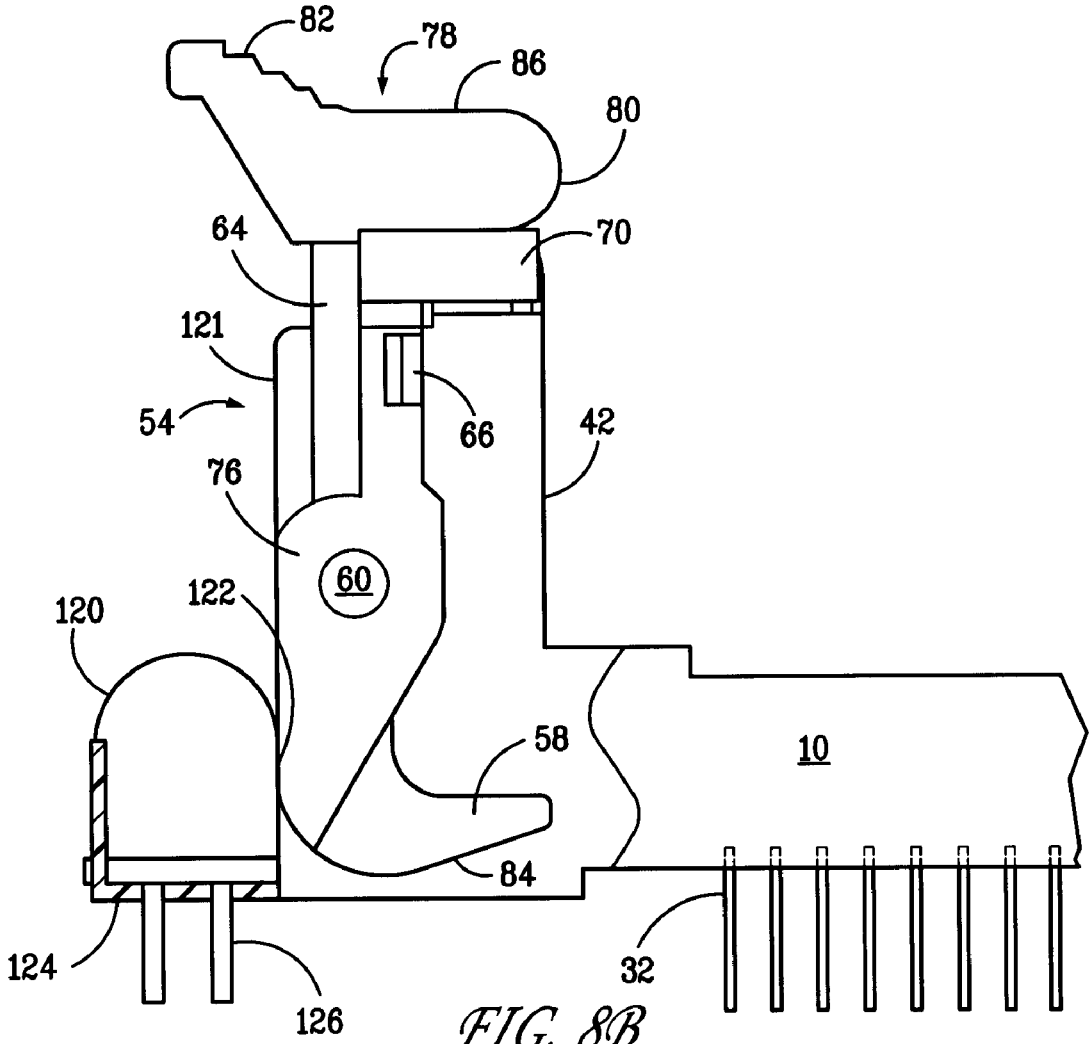
FIG. 8B is a partially cut away, partially cross-sectioned, side elevational view of the latching indicator mechanism used in a further preferred embodiment of the edge connector of the present invention.
Figure 9A:
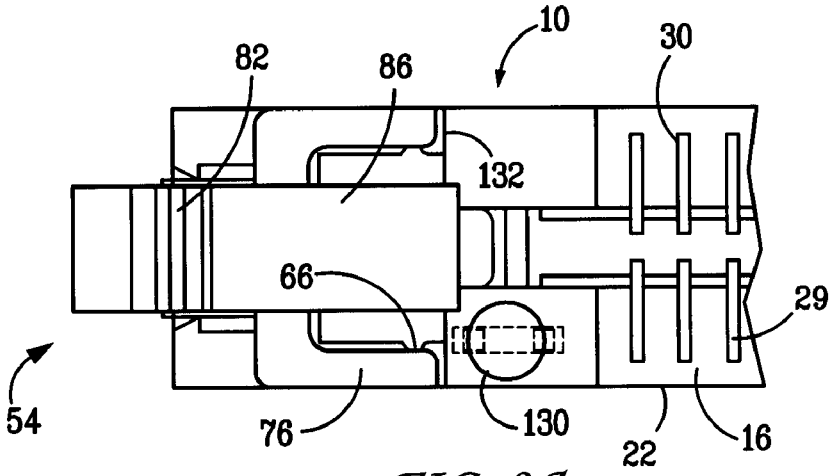
FIG. 9A is top view of the latching mechanism shown in FIG. 9B.
Figure 9B:
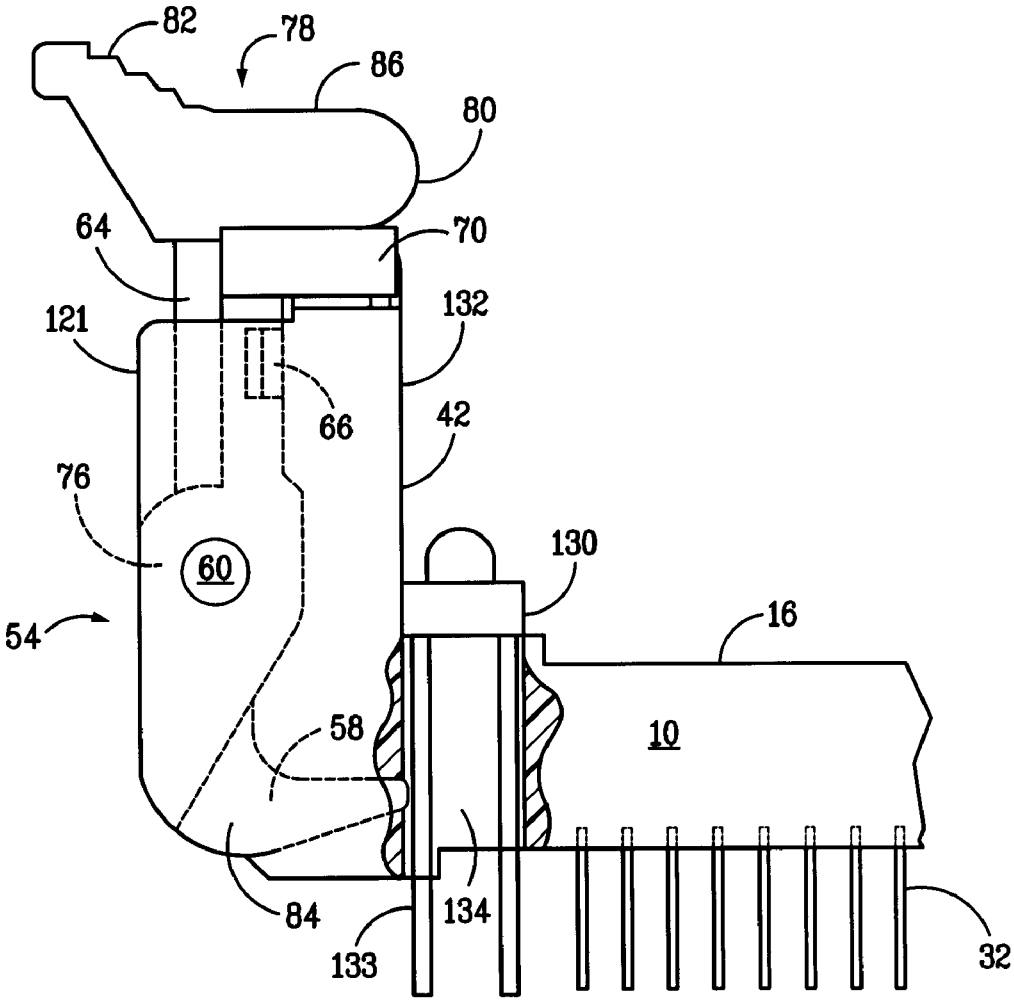
FIG. 9B is a partially cut away, partially cross-sectioned, side elevational view of the latching indicator mechanism used in a still further preferred embodiment of the edge connector of the present invention.

Referring to FIGS. 8A and 8B, in yet another preferred embodiment the light emitter 120 is supported by the housing 10 and comprises part of the connector 1. In this embodiment the light emitter 120 is mounted on the housing 10 closely adjacent to the ejector member 84. An advantage of this embodiment is that the light emitter 120 becomes an integral part of the connector 1 enabling the entire assembly to be placed on the second circuit board (not shown) at one time. In all other respects this embodiment is similar to the one described by reference to FIG. 7. The light emitter is preferably an LED which is mounted to a cup like extension 124, which is preferably a unitary extension of the housing 10. The leads 126 of the emitter 120 would be inserted into the second circuit board at the same time as the leads 32 or 34 of the connector 1

Referring now to FIGS. 1, 4, 9A and 9B, in a further preferred embodiment the light emitter 130 comprises part of the connector 1 and is mounted on the housing 10 in a way which is more compact than the embodiment of FIG. 8, so that it conserves real estate on the second circuit board (not shown). In this embodiment the emitter 130 is arranged closely adjacent to the second upstanding member 42 at its internal edge 132. The emitter 130, which is preferably an LED as in the previous embodiments, is located on the top side 16 of the housing 10 adjacent the second lateral side 22 thereof. The emitter 130 is arranged between the groove 16 and the side 22 so that it does not interfere with the insertion of the circuit card (not shown) or the movement of the member 54 between its eject position as shown in phantom in FIG. 7B and its latched position as shown in phantom in FIG. 9B. The emitter 130 may be mounted to the housing by any desired means as for example by a fastener or by the use of an adhesive. The leads 133 from the emitter extend through a hole 134 in the housing 10 so they extend outwardly from the housing to the about the same extent as the terminals 32 and 34. An advantage of this embodiment is also that the light emitter 130 being an integral part of the connector 1 enables the entire assembly to be placed on the second circuit board (not shown) at one time. The leads 132 of the emitter 130 would be inserted into the second circuit board at the same time as the leads 32 or 34 of the connector 1.

In this embodiment the emitter 130 is spaced apart from the ejector member by a larger amount than in the previous embodiments but it is still optically coupled thereto even if somewhat obliquely. Mounting the emitter 130 in this manner may even eliminate the need for the ejector member to be optically coupled thereto since the placement of the emitter 130 on the housing may by itself provide a visual status indication. However, it is preferred that the ejector member be transparent or translucent and be optically coupled as described in order to prevent blockage of the visual status indication by the circuit board 23 and the electronic components thereon.

Figure 10:
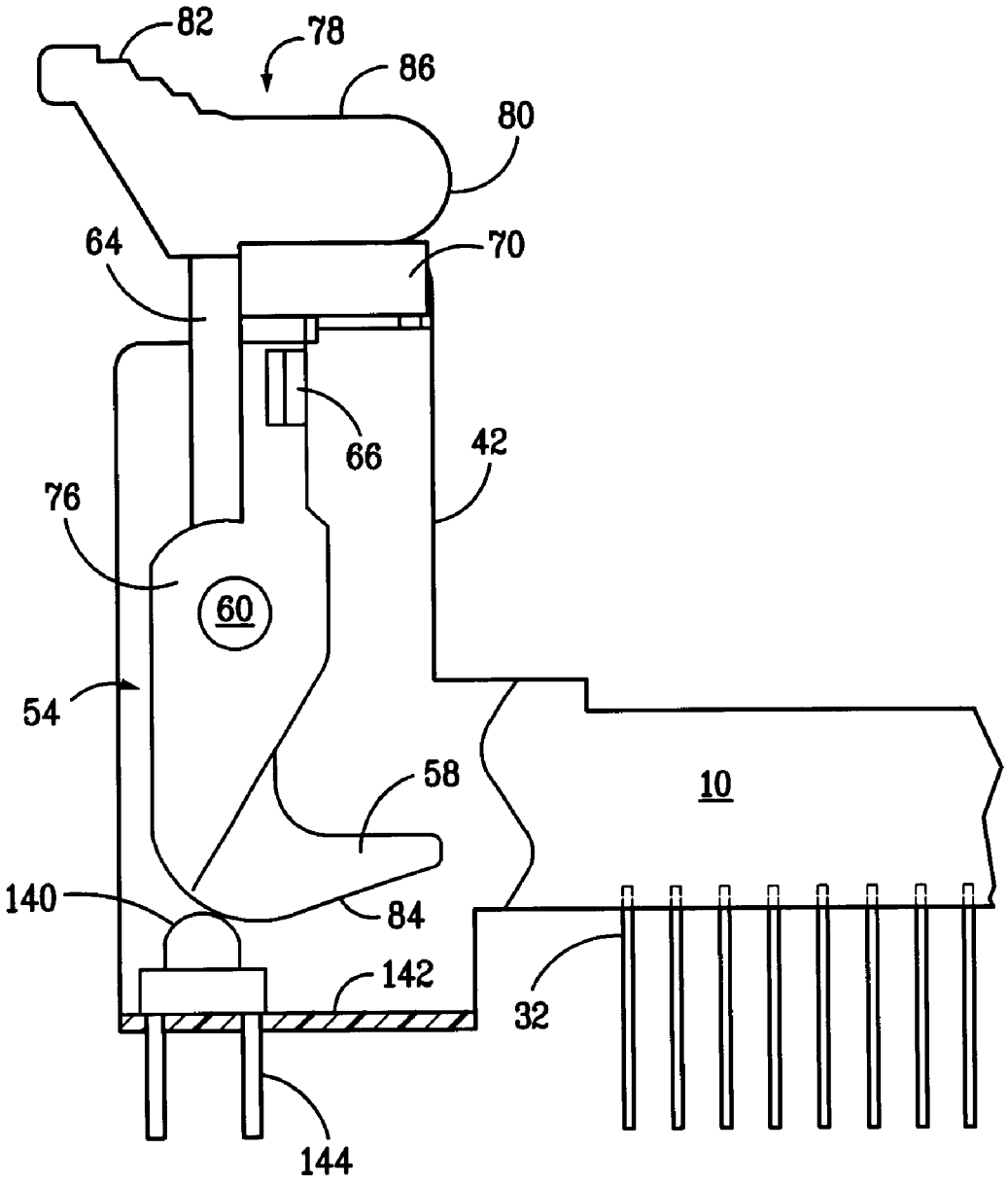
FIG. 10 is a partially cut away, partially cross-sectioned, side elevational view of the latching indicator mechanism used in yet a further preferred embodiment of the edge connector of the present invention.

Referring now to FIG. 10, there is shown one further preferred embodiment of a connector 1 wherein the light emitter 140 is mounted internally of the housing 10 in a way which is also more compact than the embodiment of FIG. 8, so that it conserves real estate on the second circuit board (not shown). In this embodiment the emitter 140 is arranged internally of the second upstanding member 42 closely adjacent to the ejector end 84 of the ejector member 54. The emitter 140, which is preferably an LED as in the previous embodiments, is supported at the bottom 142 of the second upstanding member 42 of the housing 10. As in the embodiments of FIGS. 8 and 9 an advantage of this embodiment is also that the light emitter 140 being an integral part of the connector 1 enables the entire assembly to be placed on the second circuit board (not shown) at one time. The leads 144 of the emitter 140 extend through the bottom support 142 and would be inserted into the second circuit board at the same time as the leads 32 or 34 of the connector 1. In other respects this embodiment would operate in a manner similar to the embodiments of FIGS. 5 and 6.

Most preferably the ejector member 54 is a unitary member which may also comprises a latching end 86, which locks the first circuit board in place when it is inserted into the connector.

In the embodiments of the invention wherein the light emitter is mounted to the housing it can be mounted by any desired conventional means. Optically coupled is intended to be used herein in its broadest sense to mean that light emitted by the light emitter is received by the ejector member and transmitted through the translucent or transparent ejector member.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An edge connector for receiving a first circuit board comprising:

a housing having a circuit board receiving groove;

a plurality of electrical contacts arranged in said board receiving groove;

an ejector member for ejecting said board from said housing, said ejector having first and second portions on opposite sides of a pivot point and said ejector member being at least translucent, said first portion for contact by a human finger; and a light emitter positioned immediately adjacent said second portion of said ejector and optically coupled but physically separated from said ejector member, so that when said light emitter is lit, the light from said light emitter is transmitted through said at least translucent ejector member thereby creating light in said first portion.

2. The connector as in claim 1, wherein said housing is mounted on a second circuit board and said light emitter comprises an LED mounted on said second circuit board adjacent said second portion of said ejector member.

3. The connector as in claim 2, wherein said LED is surface mounted on said second circuit board adjacent said second portion of said ejector member.

4. The connector as in claim 2, wherein said LED is mounted in a hole in said second circuit board adjacent said second portion of said ejector member.

5. The connector as in claim 2, wherein said LED comprises part of said edge connector and is mounted on said housing adjacent to said second portion of said ejector member.

6. The connector as in claim 2, wherein said LED is mounted on said second circuit board next to said housing so that the ejector member is optically coupled to said LED when said first circuit board is loaded in said housing.

7. The connector as in claim 2, wherein said LED comprises part of said edge connector and is mounted on said housing so that the ejector member is coupled to said LED when said first circuit board is loaded in said connector.

8. The connector as in claim 7, wherein said LED is arranged adjacent a side of said ejector member.

9. The connector as in claim 2, wherein said at least translucent ejector member is transparent.

10. The connector as in claim 1, wherein said ejector member is a unitary member.

11. The connector as in claim 1, wherein said ejector member is also a latching member which locks said first circuit board in place when it is inserted into said connector.

12. The connector as in claim 1 wherein said housing comprises an elongated housing having opposed ends, a bottom side, a pair of parallel longitudinal sides and wherein said board receiving groove extends longitudinally and is interposed between said longitudinal sides such that an edge of the first circuit board is receivable in said board receiving groove and wherein said plurality of electrical contacts comprise at least one longitudinal row of electrical contact elements positioned adjacent said board receiving groove.

13. The connector as in claim 5, wherein said LED is located to a side of said ejector member opposite the first circuit board.

14. The connector as in claim 5, wherein said LED is located to the same side of said ejector member as the first circuit board.

15. The connector as in claim 5, wherein said LED is located under said ejector member.

* * * * *